United States Patent [19]

Popp et al.

[11] Patent Number: 4,818,878

[45] Date of Patent: Apr. 4, 1989

[54] DOUBLE-CONTAINER UNIT FOR TRANSPORTING AND STORING RADIOACTIVE WASTE

[75] Inventors: Franz-Wolfgang Popp, Wedemark; Dietmar Flehr, Celle, both of Fed. Rep. of Germany

[73] Assignee: Deutsche Gesellschaft für Wiederaufarbeitung von Kernbrennstoffen mbH, Hannover, Fed. Rep. of Germany

[21] Appl. No.: 123,148

[22] Filed: Nov. 20, 1987

[30] Foreign Application Priority Data

Nov. 29, 1986 [DE] Fed. Rep. of Germany ..... 3639653

[51] Int. Cl.[4] ..... G21F 5/00

[52] U.S. Cl. ..... 250/507.1; 250/506.1; 252/633; 376/272; 220/254; 220/415

[58] Field of Search ..... 250/507.1, 506.1; 252/633; 376/272; 220/254, 415

[56] References Cited

U.S. PATENT DOCUMENTS

| | | | |
|---|---|---|---|
| 3,119,933 | 1/1964 | Allen | 250/507.1 |
| 3,882,315 | 5/1975 | Soldan | 250/506.1 |
| 4,302,680 | 11/1981 | Ahner et al. | 250/506.1 |
| 4,582,668 | 4/1986 | Mallory et al. | 376/272 |
| 4,594,513 | 6/1986 | Suzuki et al. | 250/506.1 |
| 4,636,645 | 1/1987 | Kessinger | 250/506.1 |

FOREIGN PATENT DOCUMENTS

| | | | |
|---|---|---|---|
| 2313746 | 12/1976 | France | 250/506.1 |

*Primary Examiner*—Bruce C. Anderson
*Assistant Examiner*—Jack I. Berman
*Attorney, Agent, or Firm*—Walter Ottesen

[57] ABSTRACT

The invention is directed to a double-container unit for transporting and storing radioactive waste such as irradiated nuclear reactor materials. The double-container unit includes an outer shielding container and an inner storage container made of steel for the gas-tight inclusion of the radioactive materials to be stored. The outer shielding container provides the required shielding and mechanical security during handling and transport of the unit. In order to simplify the assembly and manipulation of such a double-container unit, an intermediate ring is seated in the loading opening of the shielding container and is joinable with this container. A shielding cover is attachable to the intermediate ring for closing the shielding container.

18 Claims, 7 Drawing Sheets

DOUBLE-CONTAINER UNIT FOR TRANSPORTING AND STORING RADIOACTIVE WASTE

FIELD OF THE INVENTION

The invention relates to a double-container unit for transporting and storing radioactive waste such as irradiated nuclear reactor materials.

BACKGROUND OF THE INVENTION

In double-container systems for receiving and transporting radioactive materials, the two containers disposed one inside the other must fulfill different requirements. The outer shielding container conventionally has a wall thickness of 200 mm in order to provide the necessary shielding against radioactive radiation. Furthermore, this thick-walled outer shielding container is intended to provide mechanical protection of the inside container during transport and when subjected to impact loading.

The inner container receives the radioactive materials and holds them in a gas-tight manner. For this reason, the inner container can be provided with a double-cover system wherein the inner primary cover is threadably fastened to the vessel of the container and provides a gas-tight seal via appropriate seals. An outer secondary cover is welded to the vessel of the storage container where the latter is loaded or at another location.

For closing the loading opening of the outer shielding container which receives the inner storage container, it has been suggested that a closure cover be attached to the end face via machine bolts. This has the disadvantage that the weight of the inner storage container must be transmitted via the machine bolts in the event of an impact loading applied to the double-container unit.

A further suggestion provides that the shielding closure cover of the shielding container be provided with an outer thread and be screwed into the loading opening which is provided with a corresponding inner thread in the upper region thereof. This technical solution has the disadvantage that it is necessary to rotate the entire closure cover or the container for opening or closing. This requires an appropriate technical effort which complicates the nuclear facility because of the very great weight of the shielding cover and shielding vessel of the shielding container. The appropriate specialized means for assisting in this matter must then be made available at all locations.

SUMMARY OF THE INVENTION

In view of the foregoing, it is an object of the invention to provide a double-container system equipped with a cover closure which provides a simpler closure and opening of the outer shielding container.

The double-container unit according to the invention is for transporting and storing radioactive waste such as irradiated nuclear reactor materials. The double-container unit comprises: an inner storage container sealed gas-tight for storing the radioactive waste; and, an outer shielding container for holding the inner storage container therein and for providing mechanical security and shielding for the inner storage container during the handling and transport of the unit. The outer shielding container includes a vessel having a base and a wall extending upwardly from the base so as to define with the latter a cavity for receiving the inner storage container therein. The wall of the vessel terminates in an upper end portion which defines the opening of the vessel and a shielding cover is provided for covering this opening. An intermediate annular member is seated in the upper end portion and is interposed between the cover and the vessel. Joining means are provided for joining the intermediate annular cover to the upper end portion of the vessel and attachment means attach the shielding cover to the intermediate annular member.

Thus, the shielding cover is attached to the intermediate annular member for closing the shielding container with the selection of attachment means being very large and this selection can be made in accordance with the particular equipment of the nuclear facility. A further substantial advantage provided with this arrangement is that the shielding cover is significantly lighter than a threadably engageable cover having an outer winding and covering over the entire loading opening. This substantially facilitates manipulation which must be done by remotely-controlled means in nuclear facilities and is therefore of significance.

In an advantageous embodiment of the invention, the shielding cover is fastened to the intermediate annular member by means of conventional threaded fasteners.

The shielding cover can be screwed to the intermediate annular member. For opening the shielding cover, it is therefore only necessary to remove the threaded bolts for which tools such as impact wrenches can be used which are readily available in nuclear facilities.

Pursuant to another feature of the invention, the intermediate annular member includes energy-absorbing means which can, for example, be provided by configuring the annular member so as to have a portion thereof extend inwardly over the outer periphery of the inner storage container. With this configuration of the invention, it is insured that the weight of the inner storage container will be transmitted via the intermediate annular member in the event of an impact loading imparted to the double-container unit. The machine bolts which hold the shielding cover to the intermediate annular member then only have to hold this cover. Safety in the event of an impact load applied to the double-container unit is increased.

According to another feature of the invention, the intermediate annular ring can be provided with a nose-shaped portion which projects inwardly over the inner storage container. This arrangement affords the advantage that the inner storage container is secured via the nose-shaped protuberance without the loading opening of the inner storage container being blocked.

Pursuant to a still further feature of the invention, the intermediate annular member is attachable in a form-tight manner in the loading opening of the shielding container. This provides a good force-transmitting connection between the intermediate annular member and the vessel of the container. Large forces can be transmitted to the shielding container by providing a threaded connection in the opening of the shielded container by means of which the intermediate annular member threadably engages the latter. A conical configuration of the winding provides a further increased tightness of the connection of the intermediate annular member and the shielding container.

The intermediate annular member can rest with its lower end face on an inner step formed in the wall of the vessel of the shielding container which is disposed at an elevation beneath a secondary cover of the inner storage container. The secondary cover is welded or otherwise attached to the vessel of the inner storage container. With this arrangement, a ring-shaped examining space for examining the welding seam of the upper secondary cover of the inner storage container is provided after the intermediate annular member is rotated out.

Another feature of the invention provides that the ring-shaped opening of the intermediate annular member is configured so as to have a conically tapered cross section which corresponds to a concentric conical raised portion formed on the shielding cover. A centering of the shielding cover together with a good seating fit are provided by means of the conical section of the ring opening of the intermediate annular member.

A still further feature of the invention provides that the shielding cover has a lower end face which terminates above the lower surface of the intermediate annular member which projects out over the inner container. This assures that the weight of the inner storage container is caught and transmitted only through the intermediate annular member in the event of an impact load applied to the double-container unit. The cylindrical bolts therefore must only hold the shielding cover.

A further advantageous embodiment of the invention includes the feature that the intermediate annular member includes an upper ring-like projection which defines a conically tapered inside surface which acts as a centering means for the peripheral edge of the shielding cover. This conically shaped upper ring-like projection of the intermediate annular member forms a further centering for the shielding cover which is seated in the end face of the container.

Ring gaps are provided between the shielding cover and the outer ring-like projection of the intermediate annular member and between the latter and the edge of the vessel of the shielding container. According to another feature of the invention, these ring gaps are covered by means of a sealing ring which is fitted into an annular slot formed above these ring gaps. This sealing ring prevents water from penetrating into the winding between the shielding container and the intermediate annular member and into the gap between the intermediate annular ring and the shielding cover.

With the invention, a cover closure of a double-container unit is provided which offers significant advantages when loading and unloading. To open and close the outer shielding container during the loading process, only the threaded bolts holding the shielding cover to the intermediate annular member must be removed and then later retightened. The complete removal of these threaded fasteners which is desired in certain circumstances or the removal of the intermediate annular member, for example, to unload the inner storage container can be performed at a predetermined location whereat appropriate special tools are provided.

The intermediate annular member fixes the inner storage container while also making possible further handling steps after loading. By means of an appropriate automatic welding device, the secondary cover can be closed by means of a narrow gap weld and can be therefore closed in a gas-tight manner. This secondary seam assures that the fuel elements will be secured in a gas-tight manner and also over long periods of storage time. With the invention, the shielding cover is attachable to the intermediate annular member with the aid of simple attachment means such as cylinder bolts. In addition, the intermediate annular member can act to axially fix the storage container and to take up its impact loading.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
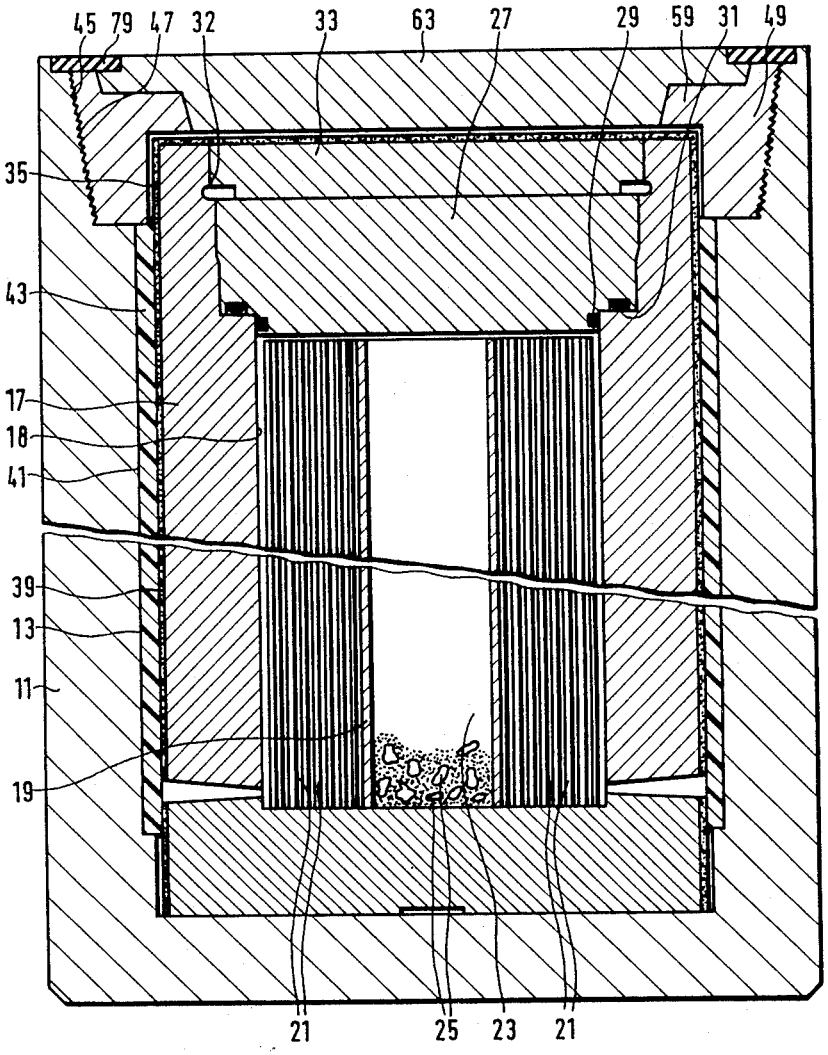
FIG. 1 is a double-container unit according to the invention which includes an outer shielding container and an inner storage container.

The double-container unit shown in FIG. 1 includes a shielding container 11 made of GGG-40 which is a cast iron containing nodular graphite. The grade GGG-40 is listed in the German nodular cast iron specifications. A storage container 17 made of steel is seated in the circular-shaped inner space 13 of the shielding container 11. The storage container 17 includes an insertable lattice 19 for receiving the individual fuel rods 21 arranged closely next to each other. The fuel rods 21 are from disassembled nuclear reactor fuel elements. The scrap pieces 25 of the disassembled nuclear reactor fuel elements are disposed in the free center space 23 of the insert lattice 19. The scrap pieces are embedded in a binding mass such as synthetic resin.

The storage space 18 of the storage container 17 is closed by means of a primary cover 27 with sealing rings 29 and 31 disposed between the cover 27 and the vessel of the storage container 17. The primary cover 27 is secured to the vessel of the container by threaded means. A secondary cover 33 is seated above the primary cover 27 in the loading opening 32 of the storage container 17 and closes tightly with the upper outer edge of the storage container 17. The secondary cover 33 is welded to the vessel of the storage container 17. The storage container 17 is provided with a corrosion-protected layer 35 applied by the process of surface-layer welding. This process is described for example in the text "Handbuch der Schweisstechnik" by J. Ruge, Volume I, second edition, page 170, published by Springer-Verlag (1980).

An annular gap 39 is provided between the inner container 17 and the outer container 11. A neutron moderator assembly 41 is mounted in this gap 39. The neutron moderator 41 comprises individual polyethylene rings 43 stacked one on top of the other.

The loading opening 45 of the shielding container 11 includes a winding portion 47 extending downwardly in a conical taper. An intermediate ring 49 is seated in this winding section 47 and is correspondingly conically configured and has an outer winding 48. The intermediate ring 49 lies with its lower end face 51 on a step 53 formed in the inner wall of the vessel of the shielding container 11. The step 53 is disposed at an elevation beneath the secondary cover 33.

The intermediate ring 49 has an outer ring-like projection 55 formed on the upper end face thereof. The outer ring-like projection 55 has a conically tapered inner surface 57. The intermediate ring 49, viewed in cross section, has a nose-shaped projection 59 projecting inwardly above the edge of the inner container 17 with the loading opening 32 of the inner container 17 being clear of the ring opening 61.

Figure 2:
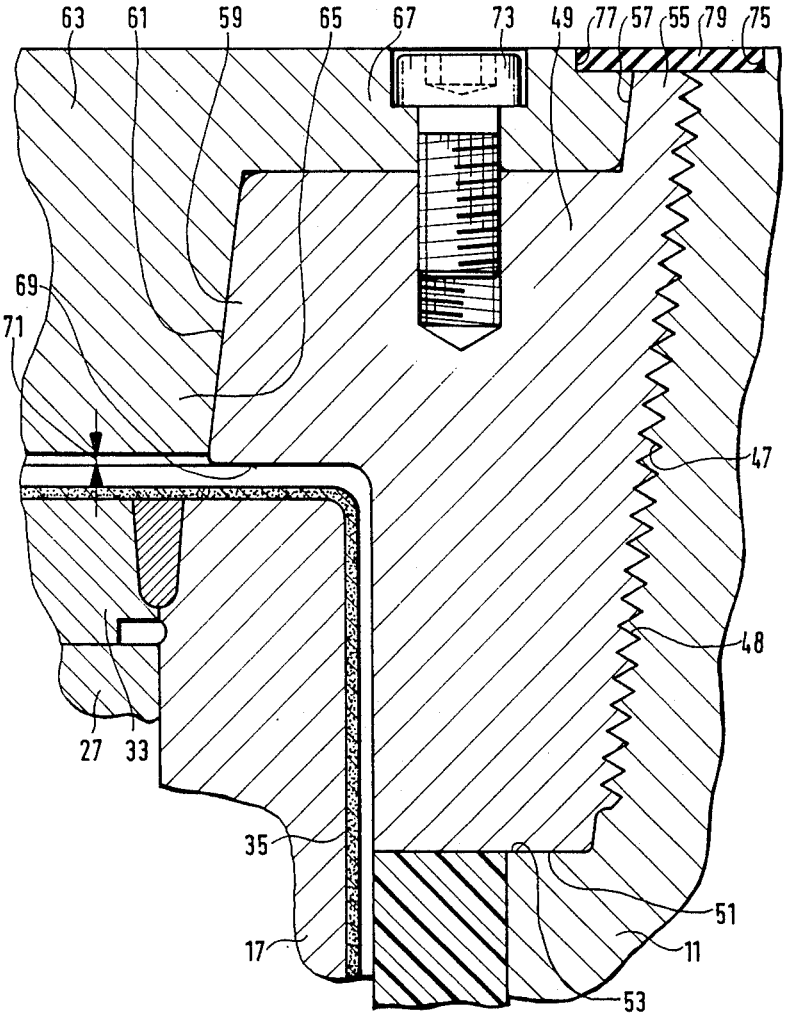
FIG. 2 is an enlarged view of a cut-away portion of the closure region of the loading opening of the outer shielding container.

Referring to FIG. 2, the cross section of the ring opening 61 of the intermediate ring 49 is conically tapered. A shielding cover 63 closes off the shielding container 11 and is correspondingly provided with a central guide portion 65 configured so as to be conical when viewed in section. The shielding cover 63 lies with its horizontal peripheral flange 67 on the intermediate ring 49. The guide portion 65 of the shielding cover 11 ends somewhat above the lower horizontal surface 69 of the nose-shaped projection 59 which projects inwardly. By means of the spacing 71 formed in this manner between the two downwardly facing surfaces of the shielding cover 63 and of the nose-shaped projection 59, it is assured that the weight of the storage container 17 is taken up and transmitted only by the intermediate ring 49 in the event of an impact load applied to the double-container unit.

The shielding cover 63 is tightly screwed to the intermediate ring 49 via cylinder bolts 73. The intermediate ring 49 serves on the one hand to axially fix the storage container 17 and takes up the impact loading of this container and, on the other hand, permits the shielding cover 63 to be secured by means of the cylindrical bolts 73.

The end face of the open end of the shielding container 11 and the upper surface of the shielding cover 63 conjointly define an annular recess (75, 77) in which a circularly-shaped sealing ring 79 is seated and screwed down. The sealing ring 79 prevents water from penetrating into the conically threaded windings (47, 48) and into the gap between the intermediate ring 49 and the shielding cover 63.

The loading and closing of the double-container system described in the foregoing is explained below.

The double-container unit is preassembled in a production facility. In this way, the inner storage container is seated in the shielding container 11. Thereafter, the intermediate ring 49 is screwed into the loading opening of the shielding container 11. The shielding cover 63 is attached to the intermediate ring 49 by means of cylinder bolts 73.

The preassembled double-container unit is opened at the loading location; that is, the shielding cover 63 is removed with conventional tools after the cylinder bolts 73 are loosened and rotated out. In this condition, the double-container unit is loaded with the radioactive material inside a shielded cell. The primary cover 27 is placed in position and screwed to the projecting wall of the storage container 17. Thereafter, the secondary cover 33 is seated and secured by means of a narrow gap weld on the container vessel. Thereafter, a surface-layer welding is formed from a corrosion-resistant metal and laid down over the weld seam. The shielding cover 63 is now seated in place and securely attached to the intermediate ring 49 by means of cylinder bolts 73 and the sealing ring 79 is inserted and mounted. The loaded double-container unit is finished for transport to another nuclear facility. The storage container 17 is now fixed and possible impact loads are taken up by the intermediate ring 49.

Figure 3:
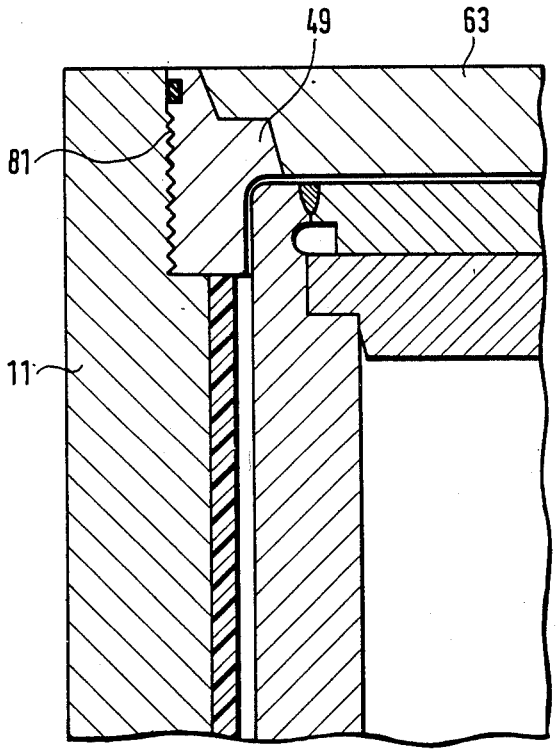
FIG. 3 is a cut-away view of the closure region of the loading opening of the outer shielding container wherein the intermediate annular member and the shielding container are joined by means of a cylindrical threaded connection.

In FIG. 3, an embodiment of the connection of the intermediate ring 49 in the loading opening of the shielding container 11 is shown with cylindrical windings 81 being provided in the loading opening and on the outer periphery of the intermediate ring 49.

Figure 4:
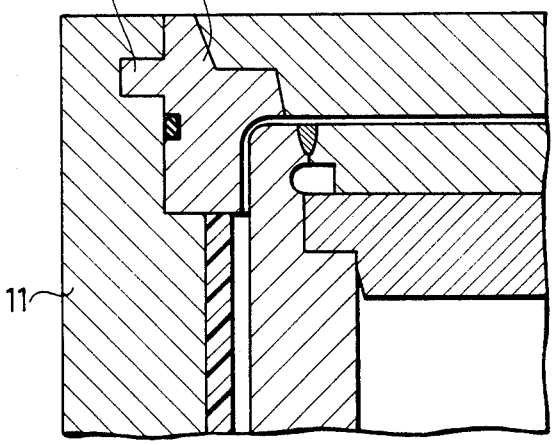
FIG. 4 is a cut-away portion of the closure region wherein the intermediate annular member and the shielding container are joined with a bayonet-like closure.
Figure 5:
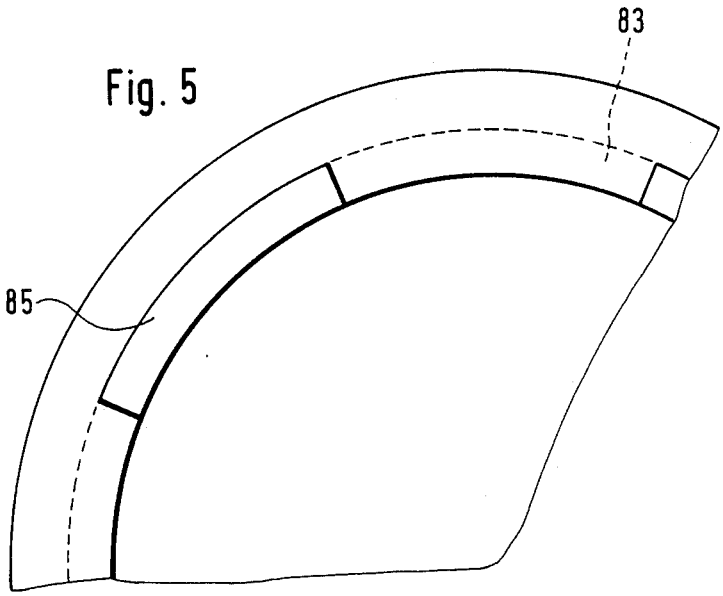
FIG. 5 is a plan view of the shielding container showing the engagement of the intermediate annular ring with the shielding container with the bayonet-like closure shown in FIG. 4.

FIGS. 4 and 5 show an embodiment of the connection between the shielding container 11 and the intermediate ring 49 wherein the intermediate ring 49 is provided with circularly-shaped segments 83 which fit into corresponding circularly-shaped recesses 85 formed in the wall of the shielding container. The ring-shaped segments 83 and the ring-shaped recesses 85 conjointly define a bayonet-like connection.

Figure 6:
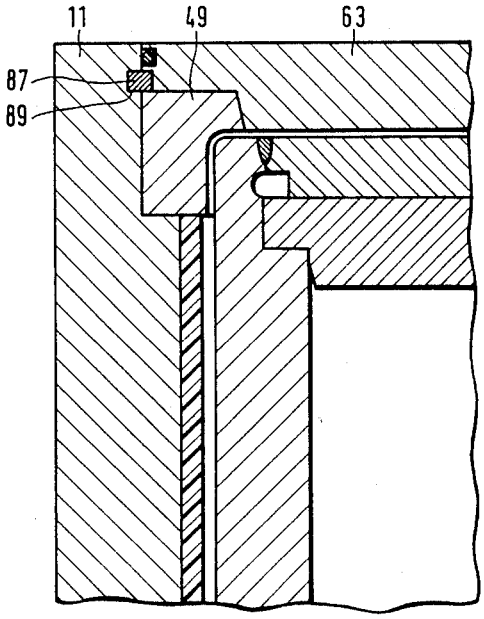
FIG. 6 is a cut-away portion showing how the intermediate annular ring can be held in a form-tight manner by means of a wedge-shaped multi-part insert ring.

In the embodiment of FIG. 6, the intermediate ring 49 is secured by a multi-part wedge-like insert ring 87 which projects into an inner peripheral slot 89 formed in the upper end portion of the vessel of the shielding container 11 defining the loading opening. The shielding cover 63 is disposed above the intermediate ring 49 and is screwed to the intermediate ring 49 with the inclusion of the insert ring 87.

Figure 7:
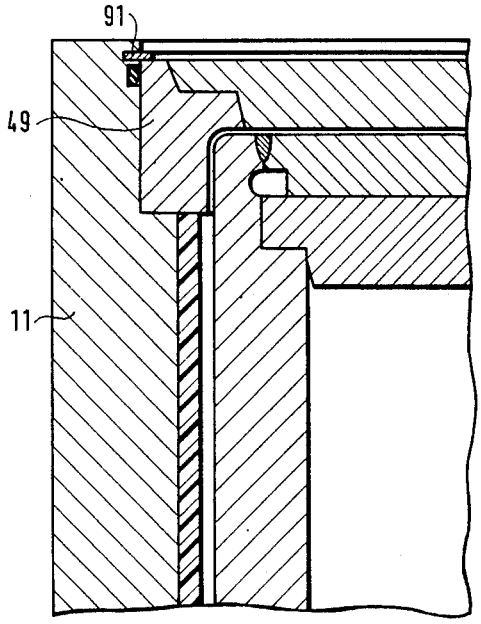
FIG. 7 is a cut-away portion of the closure region and shows how the intermediate annular member can be secured by means of a retaining ring closure.

In FIG. 7, the intermediate ring 49 is secured via a retaining ring 91 which latches in the loading opening of the shielding container 11.

Figure 8:
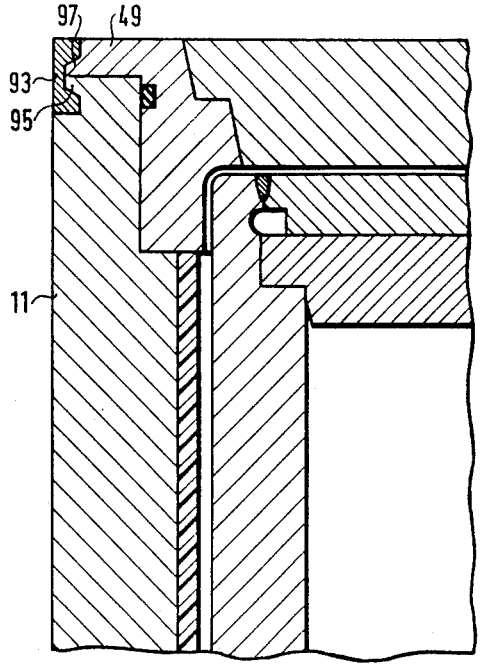
FIG. 8 is a cut-away portion of the closure region of the shielding container showing how the intermediate ring can be secured by means of a clamping closure engaging the outer periphery of the shielding container.

The connection between the shielding container 11 and the intermediate ring 49 pursuant to FIG. 8 is produced with the aid of a two-part clamping ring 93. The clamping ring 93 clampingly holds a peripheral outer flange 95 of the shielding container 11 and an outer flange 97 of the intermediate ring 49 arranged in correspondence to the outer flange 95.

Figure 9:
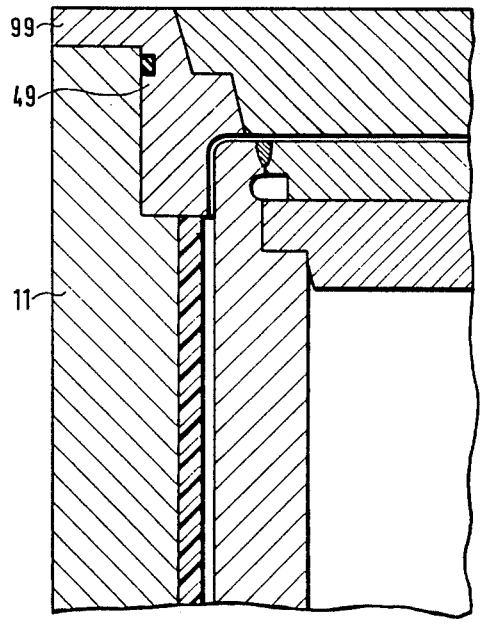
FIG. 9 is still another cut-away view of the closure region of the shielding container and shows how the intermediate annular member can be secured to the end face of the vessel of the shielding container.

In FIG. 9, the intermediate ring 49 has an outer flange 99 which is screwed to the end face of the shielding container 11.

Figure 10:
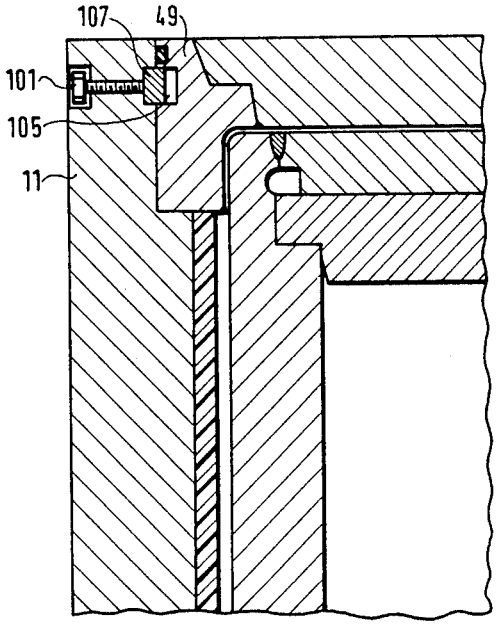
FIG. 10 is a cut-away portion of the shielding container and shows how the intermediate annular member can be attached by means of a retaining ring to which pressure is applied with the retaining ring being inserted in an outer annular slot of the intermediate annular member; and, FIG. 11 is another cut-away portion of the shielding container and shows how the intermediate annular member is secured via a multi-part profile ring engaging the outer periphery of the intermediate annular ring.
Figure 11:
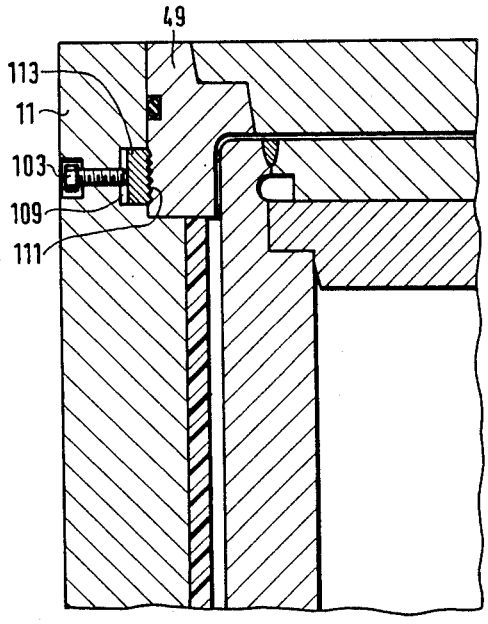

The configurations according to FIGS. 10 and 11 show respective clamping bolts (101, 103) extending through the wall of the shielding container 11 in the radial direction. On the one hand, and in FIG. 10, the pressure bolts press against a retaining ring 107 inserted in a peripheral slot 105 of the intermediate ring 49 and, on the other hand, in FIG. 11, the clamping bolts act on a multi-part profile ring 113 provided in a slot 109 of the loading opening, the profile ring 113 having teeth 111. This profile defined by teeth 111 of the profile ring 113 engages in a corresponding outer profile of the intermediate ring 49 and thereby secures the latter in a form-tight manner.

It is understood that the foregoing description is that of the preferred embodiments of the invention and that various changes and modifications may be made thereto without departing from the spirit and scope of the invention as defined in the appended claims.

What is claimed is:

1. A double-container unit for transporting and storing radioactive waste such as irradiated nuclear reactor materials, the double-container unit comprising:

an inner storage container sealed gas-tight for storing the radioactive waste;

an outer shielding container for holding the inner storage container therein and for providing mechanical security and shielding for said inner storage container during the handling and transport of said unit, said outer shielding container including a vessel having a base and a wall extending upwardly from said base so as to define with the latter a cavity for receiving said inner storage container therein;

said wall terminating in an upper end portion defining the opening of said vessel;

a shielding cover for covering said opening;

an intermediate annular member seated in said upper end portion and interposed between said cover and said vessel;

joining means for joining said intermediate annular member to said upper end portion of said vessel;

attachment means for attaching said shielding cover to said intermediate annular member;

said vessel defining a longitudinal axis and said intermediate annular member having an annular projection extending inwardly toward said longitudinal axis so as to be disposed above the outer peripheral edge of said inner storage container to receive an impact load from said inner storage container caused by a movement of the latter within said outer shielding container;

said inner storage container having an upper end face region within said outer peripheral edge thereof;

said shielding cover having a bottom end face adjacent said upper end face region when said shielding cover is seated in said vessel; and, gap means formed between said bottom end face and said upper end face region for preventing direct contact therebetween in the event of said impact load.

2. The double-container unit of claim 1, said attachment means comprising a plurality of threaded fasteners for attaching said cover to said intermediate annular member.

3. The double-container unit of claim 1, said annular projection having a flat annular upper surface defining a seat for receiving said shielding cover thereon and an annular lower surface disposed adjacent said outer peripheral edge of said inner storage container.

4. The double-container unit of claim 1, said joining means being configured so as to hold said intermediate annular member in said opening of said shielding container in a form-tight manner.

5. The double-container unit of claim 1, said joining means comprising: a first thread formed in said upper end portion of said vessel; and, a second thread formed on the outer peripheral surface of said intermediate annular member for threadably engaging said first thread to attach said annular member to said vessel in said opening.

6. The double-container unit of claim 5, said upper end portion of said vessel having a conically tapered surface formed thereon and said first thread being formed in said conically tapered surface; said outer peripheral surface of said intermediate annular member being conically tapered to correspond to said tapered surface of said vessel and said second thread being formed in said conically tapered surface of said annular member.

7. The double-container unit of claim 1, said joining means comprising a plurality of recesses formed in said upper end portion of said vessel; and, a plurality of segments formed on the outer peripheral surface of said annular member for engaging corresponding ones of said recesses so as to conjointly define therewith a bayonet-like connection.

8. The double-container unit of claim 1, said joining means comprising: recess means formed in the inner wall surface of said upper end portion of said vessel; and, a wedge-like multi-part ring seated in said recess means so as to protrude outwardly from said wall surface for engaging and holding said annular member in said vessel; and, said shielding cover being configured so as to contact engage said multi-part ring from above so as to include the latter between said shielding cover and said annular member.

9. The double-container unit of claim 1, said joining means comprising recess means formed in the inner wall surface of said upper end portion of said vessel; and, a retaining ring seated in said recess means for holding said annular member in place in said vessel.

10. The double-container unit of claim 1, said intermediate annular member having a peripheral outer portion and said joining means comprising a first annular projection formed on said peripheral outer portion; a second annular projection formed on the outer wall surface of said upper end portion of said vessel; and, clamping means for holding said first and second annular projections so as to clamp said annular member tightly to said vessel.

11. The double-container unit of claim 1, said upper end portion defining the upper end face of said vessel; said intermediate annular member having a peripheral outwardly extending flange for contact engaging said upper end face when seated in said upper end portion; and, said joining means including means for attaching said flange to said upper end face.

12. The double-container unit of claim 1, said joining means comprising slot means formed in the outer peripheral surface of said intermediate annular member; a retaining ring seated in said slot means; and, a plurality of pressure bolts extending through the wall of said vessel at said upper end portion thereof for applying a load to said retaining ring for clamping said intermediate annular member in said vessel.

13. The double-container unit of claim 1, said joining means comprising slot means formed in the inner wall surface of said upper end portion of said vessel; a multi-part profile ring seated in said slot means for contact engaging the outer peripheral surface of said intermediate annular member; and, a plurality of pressure bolts extending through the wall of said vessel at said upper end portion thereof for applying a load to said profile ring for holding said intermediate annular member in said vessel.

14. The double-container unit of claim 1, said inner storage container having an upper end face and a secondary cover seated on said upper end face; said vessel having a step formed in the inner wall surface thereof at said upper end portion so as to be at an elevation below said secondary cover; and, said intermediate annular member having a lower end face and being seated with said lower end face on said step.

15. The double-container unit of claim 1, said shielding cover having a conically-tapered concentric raised portion that extends downwardly into said vessel; said intermediate annular member having an inner wall which is conically tapered in correspondence to the taper of said raised portion so as to receive the latter in contact engagement when said shielding cover is seated on said vessel.

16. The double-container unit of claim 4, said bottom end face of said shielding cover being at an elevation above said annular lower surface of said annular projection when said shielding cover is seated in said vessel.

17. The double-container unit of claim 1, said intermediate annular member having an upwardly extending raised portion formed thereon and defining a conically-tapered surface facing the peripheral edge of said shielding cover for centering said cover at said peripheral edge thereof.

18. The double-container unit of claim 17, said peripheral edge and said conically tapered surface conjointly defining a first ring gap; the outer peripheral surface of said annular member and the inner wall surface of said upper end portion of said vessel conjointly defining a second ring gap; and, said double container unit further comprising sealing ring means for sealing both said first and second ring gaps to prevent moisture from entering said gaps.

* * * * *